US006668428B2

(12) United States Patent
Moeller

(10) Patent No.: US 6,668,428 B2
(45) Date of Patent: Dec. 30, 2003

(54) FASTENERS INCORPORATING A WHISTLE

(75) Inventor: Thomas Andrew Moeller, Los Gatos, CA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/834,588

(22) Filed: Apr. 12, 2001

(65) Prior Publication Data

US 2002/0029440 A1 Mar. 14, 2002

Related U.S. Application Data

(60) Provisional application No. 60/196,582, filed on Apr. 13, 2000.

(51) Int. Cl.[7] ..... A44B 11/04

(52) U.S. Cl. ..... 24/163 R; 24/197; 24/198

(58) Field of Search ..... 24/614–617, 625, 24/627, 197–200, 163 R, 164; 446/202, 204, 404; 116/137 R; 224/191, 219–222, 250, 255, 257, 258, 267, 910

(56) References Cited

U.S. PATENT DOCUMENTS

| | | | | | |
|---|---|---|---|---|---|
| 1,346,702 | A | * | 7/1920 | Colter | 24/305 |
| 3,774,572 | A | * | 11/1973 | Borraccio | 116/67 R |
| 3,885,250 | A | | 5/1975 | Schiller | 2/321 |
| 3,903,547 | A | | 9/1975 | Schiller | 2/321 |
| 4,067,290 | A | | 1/1978 | Hartley | 116/99 |
| 4,359,961 | A | * | 11/1982 | Seron | 116/137 R |
| 4,553,926 | A | * | 11/1985 | Crespy | 431/253 |
| 4,709,651 | A | * | 12/1987 | Lance | 116/137 R |
| 4,787,660 | A | * | 11/1988 | Mrazek | 294/1.1 |
| D298,841 | S | | 12/1988 | Green | D21/64 |
| 4,821,670 | A | | 4/1989 | Foxcroft et al. | 116/137 |
| D302,398 | S | | 7/1989 | Medina | D10/119 |
| 4,852,510 | A | | 8/1989 | Joseph, Jr. et al. | 116/140 |
| 4,893,580 | A | | 1/1990 | Joseph, Jr. et al. | 116/137 R |
| 5,002,006 | A | * | 3/1991 | Ehrenreich | 116/137 R |
| 5,245,731 | A | * | 9/1993 | Funathu | 24/200 |
| 5,312,082 | A | | 5/1994 | Chang | 248/452 |
| D350,908 | S | | 9/1994 | Tamez | D10/119 |
| 5,495,820 | A | * | 3/1996 | Seron | 116/137 R |
| 5,504,943 | A | * | 4/1996 | Han | 2/209.13 |
| 5,507,246 | A | | 4/1996 | Rand, Jr. | 116/137 R |
| D369,627 | S | | 5/1996 | Thor | D21/198 |
| 5,546,887 | A | | 8/1996 | Cameron | 116/137 R |
| D381,936 | S | | 8/1997 | Anscher | D11/216 |
| D385,819 | S | | 11/1997 | Chen | D10/119 |
| 5,794,316 | A | | 8/1998 | Anscher | 24/625 |
| 5,845,376 | A | | 12/1998 | Tung | 24/625 |
| D405,725 | S | | 2/1999 | Anscher | D11/216 |
| D409,939 | S | | 5/1999 | Sharp et al. | D10/119 |
| 5,956,985 | A | * | 9/1999 | Chang | 70/456 R |
| 6,282,802 | B1 | * | 9/2001 | Iden | 33/348 |
| 6,416,379 | B1 | * | 7/2002 | Topman | 446/204 |

FOREIGN PATENT DOCUMENTS

| | | | |
|---|---|---|---|
| EP | 885118 A2 | * | 7/1998 |
| GB | 2 277 351 A | | 10/1994 |
| JP | 409022603 A | * | 1/1997 |
| JP | 410089684 A | * | 4/1998 |
| JP | 2001125575 A | * | 5/2001 |
| WO | WO 88/05579 | * | 7/1988 |

* cited by examiner

*Primary Examiner*—Anthony Knight
*Assistant Examiner*—Ruth C. Rodriguez
(74) *Attorney, Agent, or Firm*—Mark W. Croll; Paul F. Donovan

(57) ABSTRACT

This invention relates to a device to be used for tending straps and also to be used as a whistle. More particularly, this invention relates to a device for tending straps with a whistle integrated within the device where both the whistling and strap-tending functions are independently operable. While whistles may be included as individual pieces of gear they are often not available when desired. This invention facilitates the inclusion of a whistle by combining it with items designed to tend the straps on gear that is more commonly carried.

24 Claims, 2 Drawing Sheets

FASTENERS INCORPORATING A WHISTLE

This application claims priority per 35 U.S.C. §119(e)(1) to provisional Patent Application No. 60/196,582 filed Apr. 13, 2000.

FIELD OF THE INVENTION

This invention relates to a device to be used for tending straps and also to be used as a whistle. More particularly, this invention relates to a device for tending straps with a whistle integrated within the device where both the whistling and strap-tending functions are independently operable.

BACKGROUND OF THE INVENTION

Devices for tending straps take many forms. The buckle on a typical belt is maybe the most recognizable, but fasteners with similar functions encompass a wide range of designs and related functions, see U.S. Pat. No. 5,794,316 for example. The "tending strap" function is intended to encompass the various functions performed by devices that are attached to straps, or more specifically to belts, webbing, or cords, and that work to secure the straps under tension (a buckle or webbing adjuster for example), confine them to a particular area (a slider), or limit movement of other items along the strap (a cord lock). The articles utilizing these designs are ubiquitous where one finds hikers, boaters, campers, climbers, and other persons employing similar gear. Many of these activities give rise to emergencies or other situations where the spoken word either does not carry far enough, is not loud enough to be heard over surrounding noise, or is not distinct enough to draw attention. It is often recommended that the participant carry a whistle for safety in activities where emergency situations can exist. Such needs for help, however, tend to be rather unexpected. This unexpected quality results in people not equipping themselves with whistles at all times and thus not having one when such an emergency occurs. If the whistle could be incorporated into an otherwise useful item then a person would be more likely to have one available at all times, particularly during emergencies. Aside from emergency uses, a whistle may be merely a handy means for the user to notify others of his or her presence, or otherwise get attention. There is thus a need for a device that has a function with a utility related to the activity that also incorporates a whistle that can be used relatively quickly when the need arises.

Whistles in general take many forms, for examples see U.S. Pat. Nos. 5,546,887 and 5,507,246. Such whistles undeniably perform the necessary function if they are available. But such whistles are often not available for any number of reasons. A solitary whistle is not an item that most would habitually carry. Therefore a potential user would probably need a reason to include a whistle in the gear for that day. Most of the obvious reasons are related to emergencies and most people do not anticipate having emergencies. This would make a whistle a low priority item on anyone's packing list. And because emergencies are fortunately rare, the whistle would in fact generally be just another item cluttering up a purse, key-chain, or related devices. This limited need makes it easy and understandable to simply forget to carry a whistle even should one think it a good idea in general.

But many other things are carried constantly and without additional effort. Many of the activities giving rise to the need for a whistle have a particular type of gear associated with that activity. Although the various activities do not necessarily have gear in common, the individual items of gear have common elements. One group of common elements comprises the fasteners used to secure webbing, belts, straps, and cords on this gear. These devices range from your typical belt buckles to the more high tech molded side release buckles, tension adjusters, sliders, and cord locks. They are present in gear ranging from book bags and backpacks, to key-chains, bike helmets, and the cords on the hoods of many jackets.

Buckles have been proposed incorporating tools such as a whistle, however the design has been unsatisfactory and has not gained wide spread acceptance. For example, U.S. Pat. Nos. 3,885,250 and 3,903,547 disclose a buckle with a prong that may be fashioned into a whistle. While specific details of how such a whistle might be formed are not disclosed, the general arrangement is not satisfactory because, being on a prong, such a whistle would be hidden and even if known, use would require disengagement of the retained strap or belt. Additionally, the strap must be large enough to house the whistle. This requirement prevents incorporation of a whistle where the strap is of small cross-section because the prong must be accommodated within either a thick strap or two layers of strap. This also means that the strap must be specially manufactured to accept the flange, increasing manufacturing costs and reducing the application of the buckle because it must necessarily be part of a matched set to function. Finally, since the prong is rigid and extends into the strap the areas where the buckle can be located are limited to relatively flat locations that extend the length of the prong and buckle.

Thus there exists a present need for a device with an integral whistle that can function with a variety of strap sizes and shapes to fasten, tension, lock or generally tend the straps and where the whistle is unobtrusive yet apparent and accessible to the user.

SUMMARY OF THE INVENTION

The preferred embodiments of the present invention combine the function of a whistle with that of a device for tending straps, cords, belts, or webbing of various shapes and sizes. The whistle is combined with the strap-tending device in a manner that allows the whistle to be used even when the device is tending the straps as designed. Given that a strap runs in a general direction and that the strap-tending device typically performs a function that is oriented along the same general direction, the placement of the whistle is preferably transverse to that direction to facilitate access to the whistle, decrease device dimensions, and improve its manufacturability. The strap-tending functions of the preferred embodiments include: a two-piece side release buckle with the whistle incorporated in the female half and the strap adjusting mechanism in the male half; a single piece strap adjuster with the whistle located opposite the anchor bars and slots from the extension designed to facilitate releasing tension; a cord lock with the whistle integrated into the barrel; and a slider with the whistle integrated to one side of the slots designed to engage the straps. In all cases the whistle is accessible and functional with the intended strap or straps in place and the device performing its intended strap-tending function.

BRIEF DESCRIPTION OF THE DRAWINGS

The foregoing and other aspects and advantages of the present invention will be better understood from the following detailed description of preferred embodiments of the invention with reference to the drawings, in which.

Like reference numerals refer to corresponding elements throughout the several drawings.

DETAILED DESCRIPTION OF THE PREFERRED EMBODIMENTS

Figure 2:
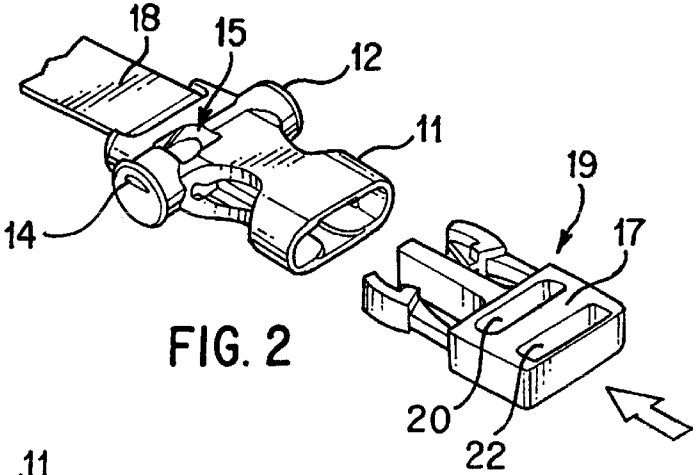
FIG. 2 is an isometric view showing the process of engaging the male and female halves of the buckle and whistle of FIG. 1.

Referring now to FIGS. 1–6, which show a preferred embodiment of the present invention, we discuss a combination side release buckle and whistle. Female body 11 comprises the female half of a side release buckle with an integral whistle portion 16 that is itself comprised of chamber 13 (seen in cross-section along line A—A in FIG. 5), exit hole (or sharp-edged lip) 15, end cap 12, and entry hole 14. Anchor bar 17 is located adjacent to chamber 13 and defines slot 20 for a strap to pass through.

Figure 3:
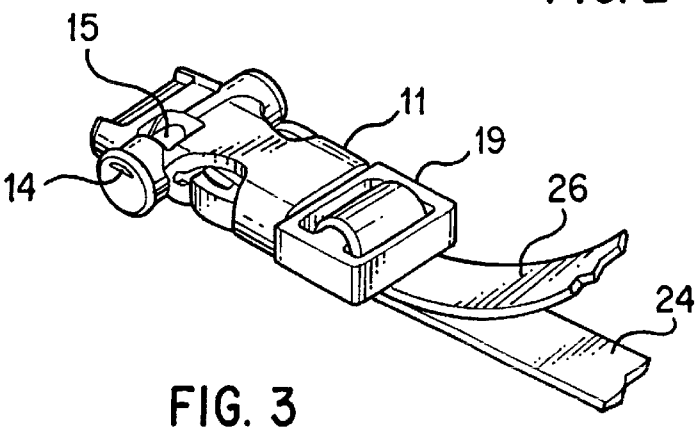
FIG. 3 is an isometric view of the engaged buckle and whistle of FIG. 1.

Chamber 13 is transverse to the direction of strap tension as shown in FIG. 2 which depicts strap 18 anchored to female body 11 using strap anchor bar 17 (not visible). Entry hole 14 is located opposite exit hole 15 from end cap 12. Notice that both entry hole 14 and exit hole 15 are accessible when strap 18 is anchored. This allows the whistle to be activated with strap 18 attached. Male body 19 comprises the male half of the side release buckle and is shown in FIG. 2 in position for coupling to female body 11. Male body 19 also comprises strap anchor bar 17 and slots 20 and 22 used for slidably securing strap 24 as shown in FIG. 3 leaving free end 26 available for further tension adjustment. Strap 24 is attached by threading it up through slot 20, around anchor bar 17, down through slot 22 and out past male body 19. Once past male body 19 strap 24 is referred to as free end 26 to facilitate discussing the adjustment of strap 24. Friction between strap 24, free end 26, anchor bar 17 and male body 19 work to keep strap 24 attached to male body 19.

As shown in FIG. 3, both entry hole 14 and exit hole 15 are accessible when strap 24 and free end 26 are secured. Notice also that holes 14 and 15 are accessible when bodies 11 and 19 are coupled. Since straps 18 and 24, free end 26, and the coupling of bodies 11 and 19 do not hinder access to holes 14 and 15 the whistle is operable independently from the function of the device.

Figure 5:
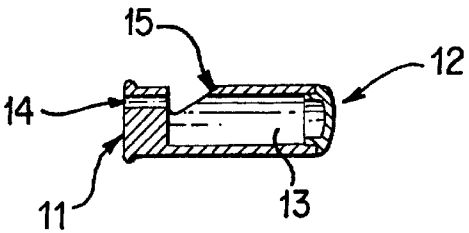
FIG. 5 is a cross-sectional view of the buckle and whistle along line A—A of FIG. 1.
Figure 1:
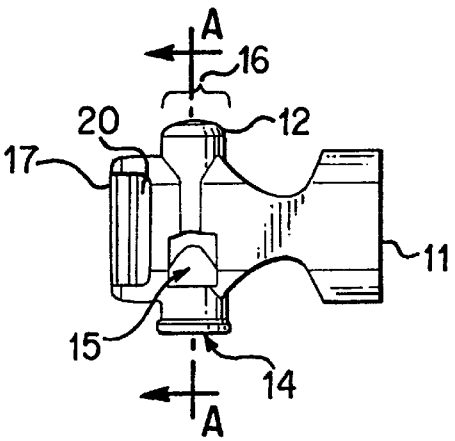
FIG. 1 is a plan view of female half of a combination side release buckle and whistle of the present invention.
Figure 4:
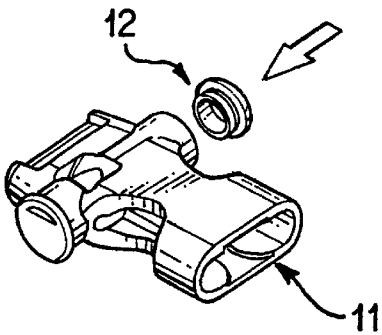
FIG. 4 is an isometric view showing the assembly of the buckle and whistle of FIG. 1.

FIGS. 4 and 5 further depict the side release buckle and whistle embodiment of the invention. In this embodiment female body 11 is a single molded item incorporating entry hole 14, exit hole 15, and the substantial majority of chamber 13. Chamber 13 is completed and the whistle made functional with the addition of end cap 12. This preferred embodiment uses annular snap fit geometry to connect end cap 12 to female body 11. One of skill in the art will recognize that all the elements of the whistle could be incorporated in male body 19, rather than female body 11, but oriented in a similar way between slot 20 and the male connecting means of the buckle. Whistle operation is effectuated by blowing air into entry hole 14. When exiting chamber 13 this air flows past the lip of exit hole 15. The combination of the air flow, lip, and chamber combine to create the whistle sound.

Figure 6:
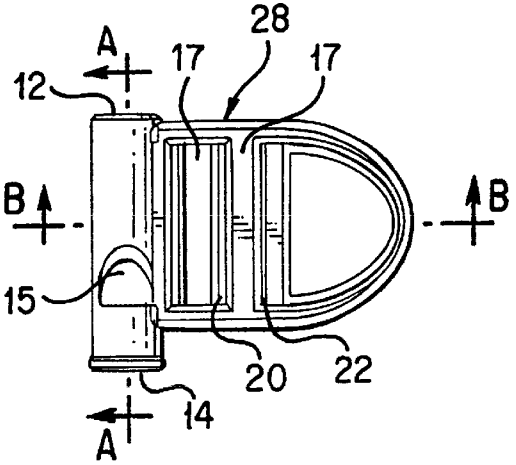
FIG. 6 is a plan view of a combination webbing length adjuster and whistle of the present invention.
Figure 7:
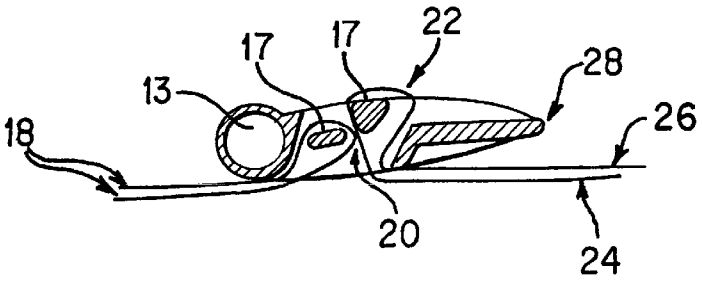
FIG. 7 is a cross-sectional view of the length adjuster and whistle along line B—B of FIG. 6.

An alternative preferred embodiment of the invention is depicted in FIGS. 6 and 7. This embodiment is termed a combination webbing length adjuster and whistle. The whistle elements and function are as described in FIGS. 4–5, but the two-piece nature of the buckle and whistle combination has been replaced by a one piece adjuster body 28. Adjuster body 28 functions to adjust webbing or strap 18 and 24 tension in a manner similar to the combination of male body 19 with female body 11 except that adjuster body 28 lacks the ability to quickly release tension that is supplied by the disconnect feature of the combination. FIG. 7 again shows how strap 18 is attached to anchor bar 17 and strap 24 is adjusted by routing it through slot 20, around anchor bar 17, and back through slot 22. Free end 26 is then used to adjust strap 24. Tension on strap 24 is released by lifting adjuster body 28 away from strap 24. Tension on strap 24 is increased by simply pulling on free end 26. One of skill in the art will recognize that straps 18 and 24 can be ends of the same strap or ends from two different straps depending on the intended function of the device. Note that as shown in FIGS. 6 and 7, straps 18 and 24 and free end 26 do not obstruct entry hole 14 and exit hole 15, making the whistle operational even when the device is also tending straps 18 and 24.

Figure 9:
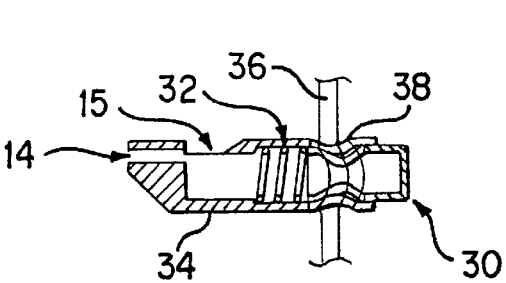
FIG. 9 is a cross-section of the cord lock and whistle along line C—C of FIG. 8.
Figure 8:
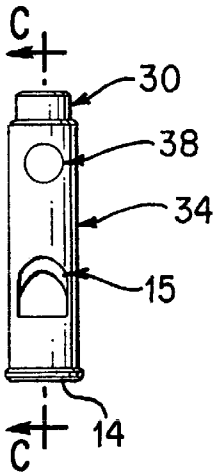
FIG. 8 is a plan view of a cord lock and whistle of the present invention.

A cord lock and whistle combination is depicted in FIGS. 8 and 9. In this device the release button 30 and compression spring 32 are slidably engaged inside lock body 34 and retained by cord 36 passing through the cord hole 38 as shown in FIG. 9 along line C—C from FIG. 8. Cord hole 38 passes through both lock body 34 and release button 30. Tension in cord 36 is adjusted by depressing release button 30 and sliding lock body 34 in the appropriate direction along cord 36. Cord 36 is bound by lock body 34 by the deformation of cord 36 and friction between cord 36, lock body 34, and release button 30. The deformation and friction are caused when compression spring 32 forces release button 30 against cord 36, which is in turn forced against lock body 34. Chamber 13 is defined by lock body 34, once again transverse to the direction of cord tension. The chamber is completed by release button 30, which fulfills the function previously performed by end cap 12 of the other preferred embodiments. Note again that cord 36 does not obstruct entry hole 14 or exit hole 15 making the whistle operational even when the device is also tending cord 36.

Figure 10:
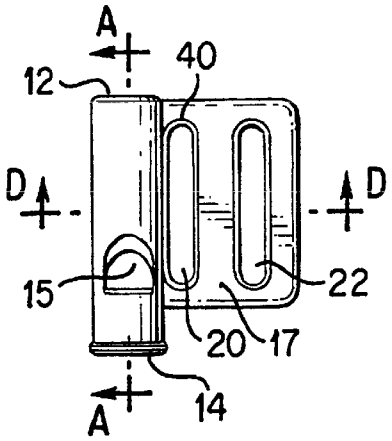
FIG. 10 is a plan view of a webbing slider and whistle of the present invention.
Figure 11:
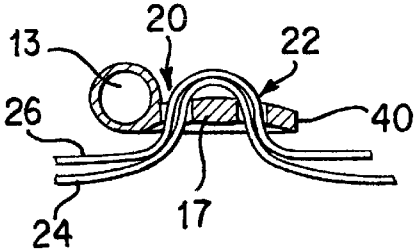
FIG. 11 is a cross-section of the slider and whistle along line D—D of FIG. 10.

An additional preferred embodiment is the slider and whistle combination of FIGS. 10 and 11. The slider device is designed to permit two or more pieces of webbing to be slideably engaged relative to one another. FIG. 11 depicts the routing as seen along line D—D from FIG. 10 where slider body 40 is shown engaging strap 24 and free end 26 after they have passed through adjuster body 28 (not shown), or side release buckle 3 (not shown). The geometry of slots 20 and 22 and anchor bar 17 is different in this embodiment from that in side release buckle male body 19 or adjuster body 28 due to the different frictional requirements of the slider. The routing of strap 24 and free end 26 from another strap-tending device highlights one desirable aspect of the invention where multiple whistles can be located on a single item of gear without increasing the number of parts needed to make the piece of gear functional. Incorporating whistles into all strap-tending elements would make accessing a whistle much easier and potentially decrease the manufacturing costs associated with adding a whistle to any one device.

While the foregoing description and drawings represent the preferred embodiments of the present invention, it will be understood that various additions, modifications and substitutions may be made therein without departing form the spirit and scope of the present invention as defined in the accompanying claims. In particular, it will be clear to those skilled in the art that the present invention may be embodied in other specific forms, structures, arrangements, proportions, and with other elements, materials, and components, without departing from the spirit or essential characteristics thereof. The presently disclosed embodiments are therefore to be considered in all respects as illustrative and not restrictive, the scope of the invention being indicated by the appended claims, and not limited to the foregoing description.

I claim:

1. A strap-tending device with an integral whistle, comprising:

a body adapted for tending at least one strap oriented in a first direction, said body comprising side members joined by an anchor bar to define at least one slot;

buckling means opposite said at least one slot from said anchor bar; and a whistle integrated into said body, said whistle including an entry hole and an exit hole that is separate and spaced from said entry hole.

2. The device according to claim 1, wherein said whistle is positioned within said body such that it is operable from a second direction approximately transverse to said first direction.

3. The device according to claim 1, wherein said buckling means comprises a male connecting means of a side release buckle.

4. The device according to claim 1, wherein said buckling means comprises a female connecting means of a side release buckle.

5. A strap-tending device with an integral whistle, comprising:

a body adapted for tending at least one strap oriented in a first direction, said body comprising side members joined by first and second anchor bars to define a first, second, and third slot; and a whistle integrated into said body, said whistle including an entry hole and an exit hole that is separate and spaced from said entry hole.

6. A strap-tending device with an integral whistle, comprising:

a body adapted for tending at least one strap oriented along a first direction, said body comprising side members joined by an anchor bar to define at least one slot; and a whistle chamber integrally formed with said body along an axis at least substantially transverse to said first direction, wherein said body further defines a whistle entry hole and a whistle exit hole communicating with said chamber, said holes being disposed on said body so as to be at least substantially free of said at least one strap when tended.

7. The device according to claim 6, wherein said body further comprises buckling means opposite said at least one slot from said anchor bar.

8. The device according to claim 7, wherein said buckling means comprises a male connecting means of a side release buckle.

9. The device according to claim 7, wherein said buckling means comprises a female connecting means of a side release buckle.

10. The device according to claim 6, wherein said body comprises side members joined by first and second anchor bars to define a first, second, and third slot.

11. A strap-tending device with an integral whistle, comprising:

a body adapted for tending at least one strap oriented in a first direction, said body comprising side members joined by an anchor bar to define at least one slot, said body further comprising buckling means opposite said at least one slot from said anchor bar; and a whistle integrated into said body, said whistle defining an entry hole and an exit hole formed into said body such that said tending at least one strap does not obstruct the operation of said whistle, wherein said entry hole and said exit hole lay along a line where said line is approximately transverse to said first direction.

12. The device of claim 11, wherein said connecting means comprises a male connecting means of a side release buckle.

13. The device of claim 11, wherein said connecting means comprises a female connecting means of a side release buckle.

14. A strap-tending device with an integral whistle, comprising:

a body adapted for tending at least one strap oriented in a first direction, said body comprising side members joined by at least one anchor bar to define at least two slots; and a whistle having an entry hole and an exit hole communicating with a whistle chamber integrated into said body with said at least two slots to one side of said whistle chamber.

15. The device of claim 14, wherein said body further comprises an adjuster portion opposite said at least two slots from said whistle chamber.

16. A strap-tending device with an integral whistle, comprising:

a body adapted for tending at least one strap; and a whistle integrally formed with said body such that such body and said whistle are formed as a single plastic molded component, said whistle including an air entry hole and an air exit hole wherein the whistle includes a first end portion which includes said air entry hole and a second open end, and wherein said device further includes a cap adapted to close said open end.

17. The device according to claim 16, wherein said body is adapted for tending at least one strap oriented in a first direction, and wherein said body comprises side members joined by an anchor bar to define at least one slot.

18. The device according to claim 17, wherein said whistle makes up one end of said body.

19. The device according to claim 16, further comprising buckling means integrally formed with said body, such that said body, said whistle, and said buckling means are formed as a single plastic molded unit.

20. The device according to claim 19, wherein said buckling means comprises a male connecting means of a side release buckle.

21. The device according to claim 19, wherein said buckling means comprises a female connecting means of a side release buckle.

22. The device according to claim 16, wherein said body is adapted for tending at least one strap oriented in a first direction, and wherein said whistle is positioned within said body such that it is operable from a second direction approximately transverse to said first direction.

23. The device according to claim 22, wherein said whistle further includes a chamber that extends between and is in communication with said air entry hole and said air exit hole.

24. The device according to claim 16, wherein said cap is adapted to be snap-fitted to said open end of said whistle.

* * * * *